US010292497B1

(12) United States Patent
Perkins

(10) Patent No.: US 10,292,497 B1
(45) Date of Patent: May 21, 2019

(54) PERIMETER SUPPORTED SEAT ASSEMBLIES AND ASSOCIATED METHODS

(71) Applicant: Toyota Motor Engineering & Manufacturing North America, Inc., Erlanger, KY (US)

(72) Inventor: Blair C. Perkins, Georgetown, KY (US)

(73) Assignee: Toyota Motor Engineering & Manufacturing North America, Inc., Plano, TX (US)

( * ) Notice: Subject to any disclaimer, the term of this patent is extended or adjusted under 35 U.S.C. 154(b) by 0 days.

(21) Appl. No.: 15/877,826

(22) Filed: Jan. 23, 2018

(51) Int. Cl.
*A47C 3/18* (2006.01)
*A47C 9/00* (2006.01)

(52) U.S. Cl.
CPC . *A47C 3/18* (2013.01); *A47C 9/00* (2013.01)

(58) Field of Classification Search
CPC ..... A47C 3/18; A47C 9/00
USPC ..... 297/344.21, 344.26
See application file for complete search history.

(56) References Cited

U.S. PATENT DOCUMENTS 3,785,700 A * 1/1974 Kubo ..... A47C 1/023 297/344.26 X
5,113,851 A 5/1992 Gamba
5,335,970 A * 8/1994 Bryant ..... A47C 9/06 297/344.26 X
5,379,701 A * 1/1995 Sumi ..... A47C 9/022 297/344.21 X
5,762,398 A * 6/1998 Gonzalez ..... A47C 3/18 297/344.26 X
6,015,188 A 1/2000 Yundt et al.
6,997,512 B1 * 2/2006 Yu ..... A47C 3/16 297/344.26 X
7,325,875 B1 * 2/2008 Guerrini ..... A47C 1/14 297/344.21
7,328,952 B2 * 2/2008 Guerrini ..... A47C 1/14 297/344.21
7,891,629 B2 2/2011 Moyers
2008/0191534 A1 8/2008 Ropp
2016/0374472 A1 * 12/2016 Horn ..... A47C 3/18 297/344.21

FOREIGN PATENT DOCUMENTS

CN 201617485 11/2010
KR 20110024349 3/2011

* cited by examiner

*Primary Examiner* — Rodney B White
(74) *Attorney, Agent, or Firm* — Dinsmore & Shohl LLP

(57) ABSTRACT

A seat assembly includes a seat support frame assembly comprising a mounting structure that mounts to a seat support structure and a seat receiving portion. The seat receiving portion includes a seat frame member having a body having an interior surface that defines a seat member receiving opening having an inner diameter. A rotatable member extends from the interior surface of the body into the seat member receiving opening. A seating member assembly is rotatably received in the seat member receiving opening. The seating member assembly includes a seat support housing that supports a seat. The seat support housing includes a side wall and a side support ledge that overhangs the rotatable member to rotatably support the seating member along a perimeter of the side wall of the seat support housing.

19 Claims, 12 Drawing Sheets

46

PERIMETER SUPPORTED SEAT ASSEMBLIES AND ASSOCIATED METHODS

TECHNICAL FIELD

The present specification generally relates to seat assemblies and, in particular, perimeter supported seat assemblies that can be used in regions of reduced head space, such as for assembly within an interior of a vehicle on an assembly line.

BACKGROUND

Seat assemblies are frequently used to improve ergonomic conditions when, for example, attending to a task, such as during an assembly operation. As one example, seat assemblies may be employed when assembling vehicles as the vehicles move along an assembly line. Many of the components of the vehicles need installed from within the vehicle. Vehicles often have low head spaces for performing such assembly tasks. Seat assemblies may be provided that can be used by operators to move into and out of interiors of the vehicles during assembly operations.

SUMMARY

In one embodiment, a seat assembly includes a seat support frame assembly comprising a mounting structure that mounts to a seat support structure and a seat receiving portion. The seat receiving portion includes a seat frame member having a body having an interior surface that defines a seat member receiving opening having an inner diameter. A rotatable member extends from the interior surface of the body into the seat member receiving opening. A seating member assembly is rotatably received in the seat member receiving opening. The seating member assembly includes a seat support housing that supports a seat. The seat support housing includes a side wall and a side support ledge that overhangs the rotatable member to rotatably support the seating member along a perimeter of the side wall of the seat support housing.

In another embodiment, a seat assembly includes a seat support frame assembly including a mounting structure that mounts to a seat support structure and a seat receiving portion. The seat receiving portion includes a seat frame member having a body having an interior surface that defines a seat member receiving opening having an inner diameter. A rotatable member extends from the interior surface of the body into the seat member receiving opening. A seating member assembly is rotatably received in the seat member receiving opening. The seating member assembly includes a seat support housing that supports a seat. The seat support housing includes a side wall. The rotatable member engages the seat support housing along a height of the side wall thereby supporting the seating member assembly vertically such that the seating member rotates in response to an external force applied to the seating member assembly.

In another embodiment, a method of rotatably supporting a seating member assembly within a seat support frame assembly is provided. The method includes placing a seating member assembly within a seat member receiving opening of a seat support frame. The seat support frame includes a seat receiving portion including a seat frame member having a body having an interior surface that defines a seat member receiving opening having an inner diameter. A side support ledge of a seat support housing is located on a rotatable member that extends from the interior surface of the body into the seat member receiving opening. The seat support housing includes a side wall and the side support ledge that extends outwardly from the side wall. The rotatable member supports the seat support housing along a perimeter of the side wall.

These and additional features provided by the embodiments described herein will be more fully understood in view of the following detailed description, in conjunction with the drawings.

BRIEF DESCRIPTION OF THE DRAWINGS

The embodiments set forth in the drawings are illustrative and exemplary in nature and not intended to limit the subject matter defined by the claims. The following detailed description of the illustrative embodiments can be understood when read in conjunction with the following drawings, where like structure is indicated with like reference numerals and in which:

DETAILED DESCRIPTION

Embodiments described herein generally relate to seat assemblies that can be used during vehicle assembly operations. The seat assemblies include seating member assemblies that rotate, are perimeter supported and have relatively low profiles compared to known seat assemblies that rotate and are bottom supported, which can result in relatively high profiles due to the bottom support. The seating member assemblies include a seat support housing and a side support ledge that extends outwardly from a perimeter of the seat support housing. The side support ledge may be located on a rotatable member that rotatably supports the seat support housing within an interior volume of a seat support frame assembly. The seat support frame assembly may be connected to another seat support structure, such as a gantry arm, which can be used to facilitate movement of the seat assembly during a vehicle assembly operation. While the seat assemblies being connected to gantry arms are described below, it should be understood that the seat assemblies may be connected to other seat support structures.

Figure 1:
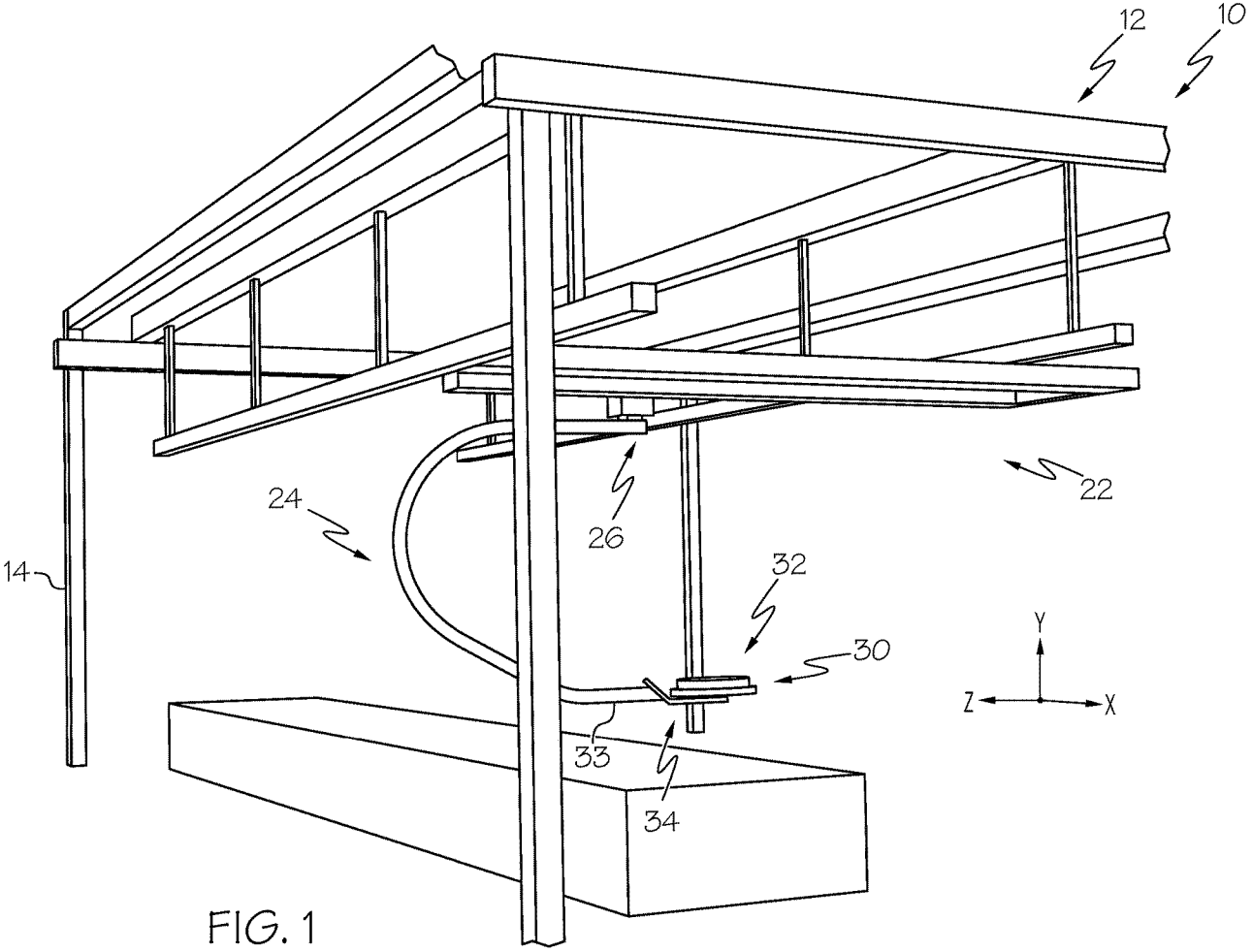
FIG. 1 is a schematic perspective view of a gantry assembly including a gantry arm and a seat assembly connected to an end of the gantry arm, according to one or more embodiments shown and described herein.

Referring to FIG. 1, the seat assemblies described herein may be used with a gantry assembly 10, as an example. The gantry assembly 10 includes an overhead support assembly 12 and support beams 14 that extend downwardly from the overhead support assembly 12 in a vertical direction (+/−Y). As used herein, the term "longitudinal direction" refers generally to a conveyance direction (+/−X) of vehicles for assembly through the gantry assembly 10 and "lateral direction" refers generally to a cross-conveyance direction (+/−Z) and is generally perpendicular to the longitudinal direction.

A track assembly 22 may be supported vertically by the overhead support assembly 12. A gantry arm 24 may be moveably connected to the track assembly 22 such that the gantry arm 24 is translatable in one or both of the lateral and longitudinal directions. The gantry arm 24 may also be rotatably connected to the track assembly 22 by mounting structure 26 that slides along the track assembly 22 and provides an axis of rotation about which the gantry arm 24 can rotate. While a C-shaped, fixed length gantry arm is illustrated, other gantry arms may be used, such as a telescoping gantry arm or other suitable gantry arm arrangement, as needed by a particular assembly operation.

A seat assembly 30 is mounted at a terminal end 33 of the gantry arm 24. The seat assembly 30 may be fixedly mounted to the terminal end 33 of the gantry arm 24 using any suitable structure, such as fasteners and/or welding. Using fasteners can allow the seat assembly 30 to be readily removed from the gantry arm 24 and replaced by a different seat assembly, if desired. The seat assembly 30 generally includes a seating member assembly 32 that is rotatably supported by a seat support frame assembly 34. The seat support frame assembly 34 is, in turn, mounted to the gantry arm 24.

Figure 2:
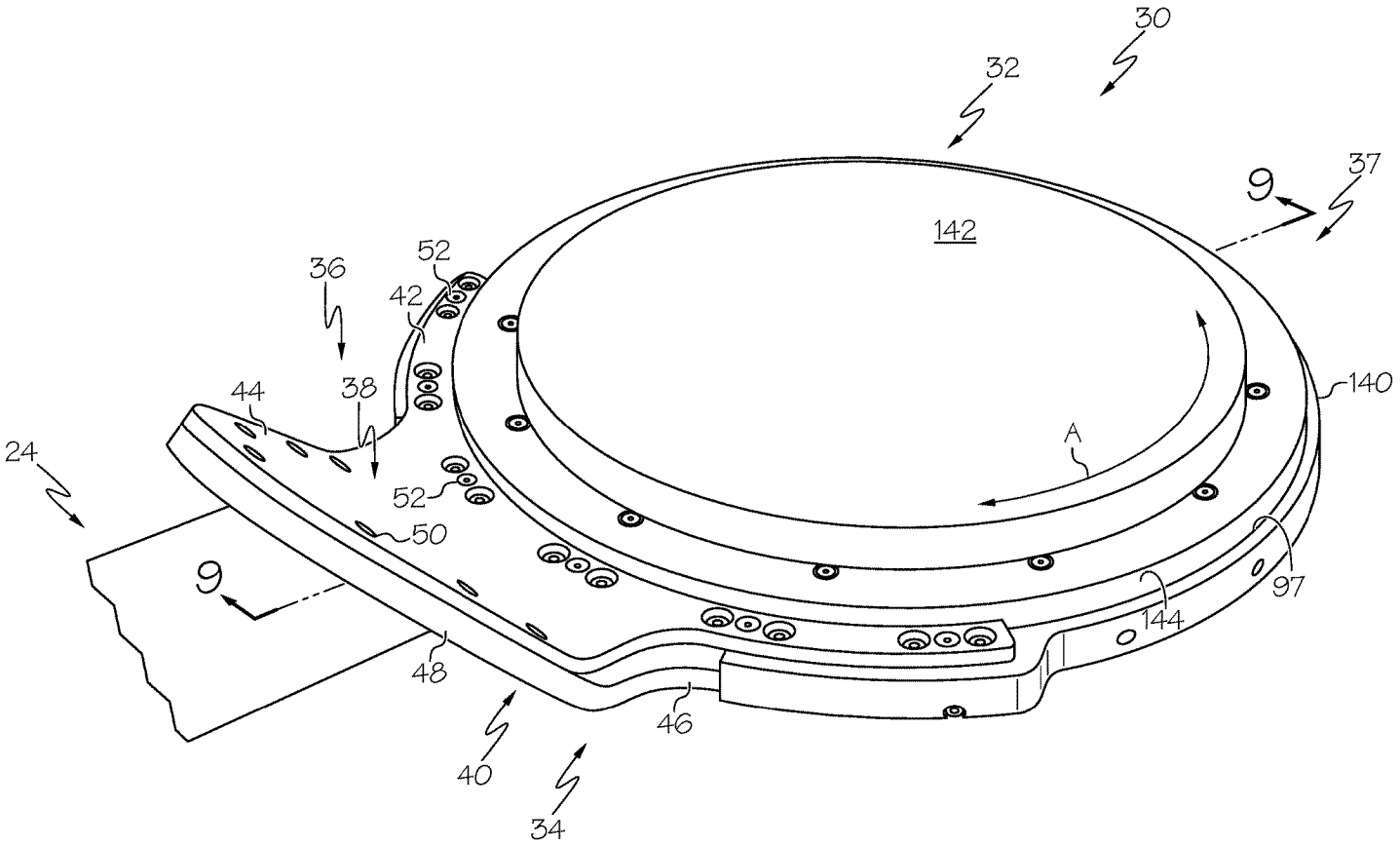
FIG. 2 is a more detailed view of the seat assembly of FIG. 1, according to one or more embodiments shown and described herein.

Referring to FIG. 2, the seat assembly 30 is illustrated in greater detail and includes the seating member assembly 32 that is rotatably mounted to the seat support frame assembly 34 such that the seating member assembly 32 can rotate due to an external manual force in the directions of arrows A, in both clockwise and counterclockwise directions. The seat support frame assembly 34 includes a back mounting portion 36 that is connected to a front seat receiving portion 37. The back mounting portion 36 may be connected to the gantry arm 24 while the front seat receiving portion 37 has an open volume that is sized and shaped to rotatably receive the seating member assembly 32, as will be described in greater detail below.

Figure 3:
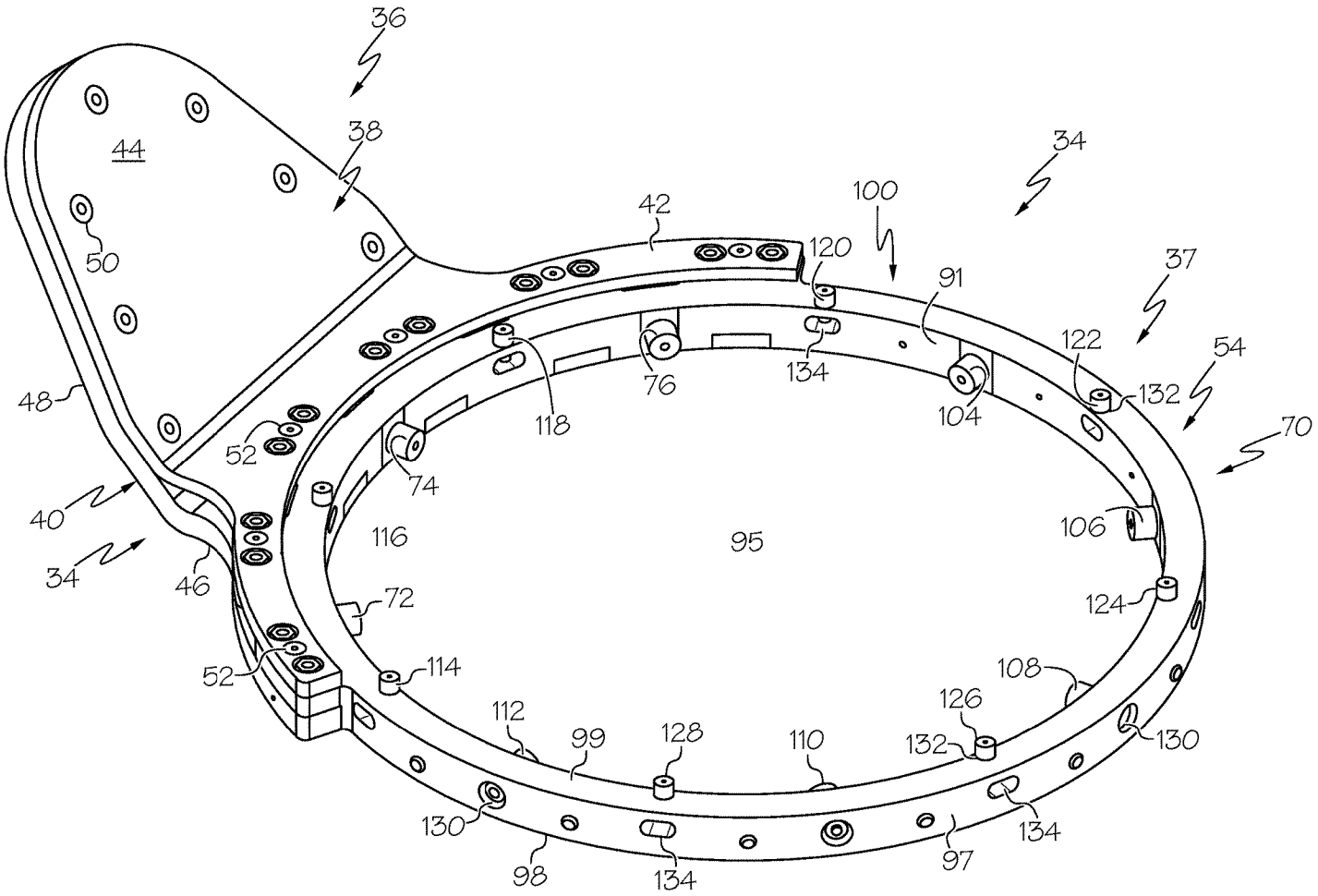
FIG. 3 is a perspective view of a seat support frame assembly for use with the seat assembly of FIG. 2 in isolation, according to one or more embodiments shown and described herein.

Referring also to FIG. 3 illustrating the seat support frame assembly 34 in isolation, the back mounting portion 36 may be formed using an upper mounting member 38 and a lower mounting member 40. The upper mounting member 38 includes a seat frame mounting portion 42 and a gantry mounting portion 44 that extends upwardly and outwardly from the seat frame mounting portion 42. Likewise, the lower mounting member 40 includes a seat frame mounting portion 46 and a gantry mounting portion 48 that extends upwardly and outwardly from the seat frame mounting portion 46. The gantry mounting portions 44 and 48 are shaped and arranged to connect together in a face-to-face arrangement using fastening locations 50 and the seat frame mounting portions 42 and 46 are shaped and arranged to connect together using fastening locations 52 thereby sandwiching a seat frame member 54 therebetween.

Figure 4:
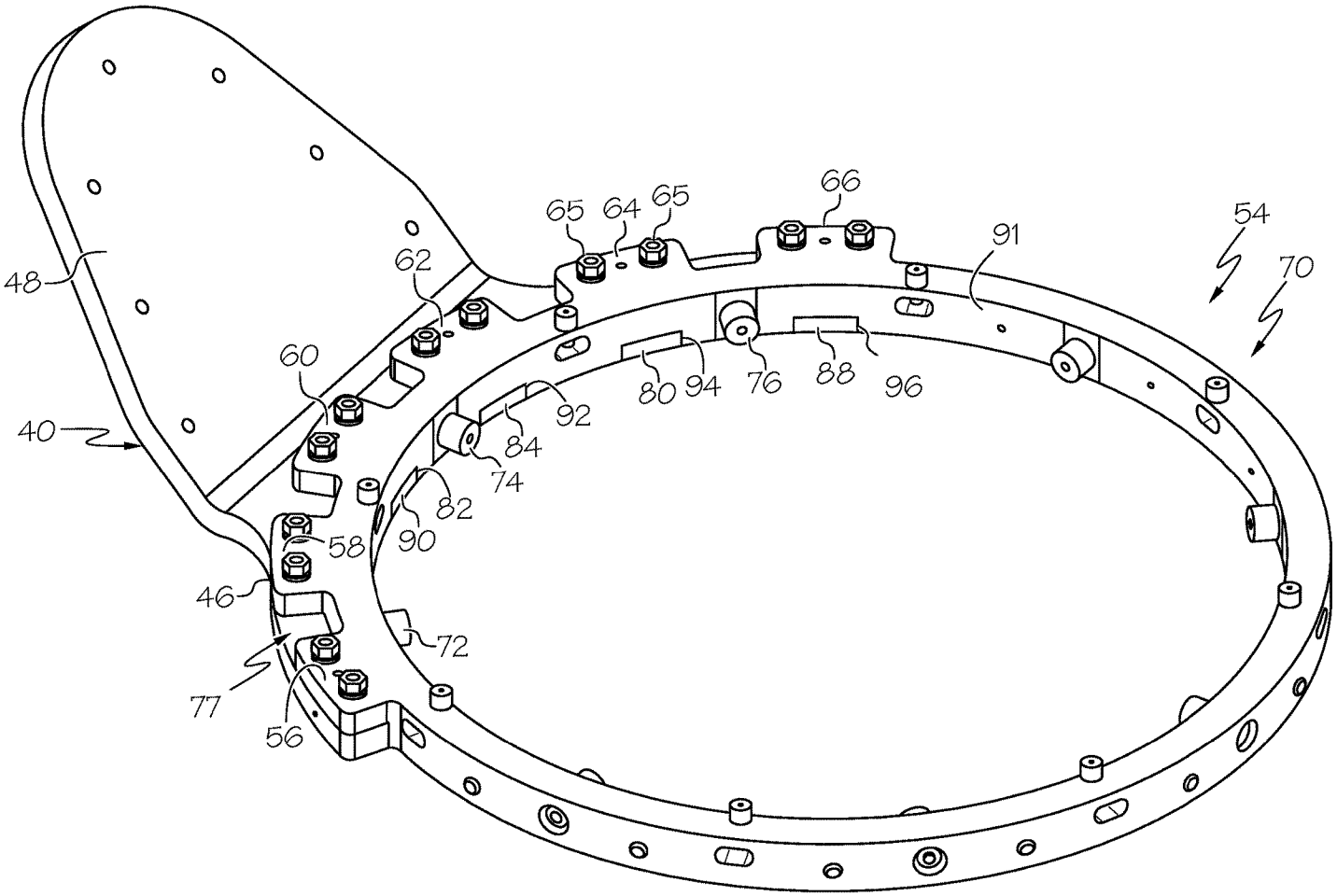
FIG. 4 is a perspective view of the seat support frame assembly of FIG. 3 with an upper mounting member removed, according to one or more embodiments shown and described herein.

FIG. 4 illustrates the seat support frame assembly 34 with the upper mounting member 38 removed. As can be seen, the seat frame member 54 includes protrusions 56, 58, 60, 62, 64 and 66 that extend outwardly into a space between the upper mounting member 38 and the lower mounting member 40. The upper mounting member 38 may be connected to each protrusion 56, 58, 60, 62, 64 and 66 at fastening locations 52, while the protrusions 56, 58, 60, 62, 64 and 66 are connected to the lower mounting member 40 at fastening locations 65 adjacent the fastening location 52. The protrusions 56, 58, 60, 62, 64 and 66 are spaced from each other about a periphery 68 of a ring-shaped body 70 of the seat frame member 54 to provide access locations 77 to access rotatable members 72, 74 and 76, which will be described in greater detail below.

Figure 5:
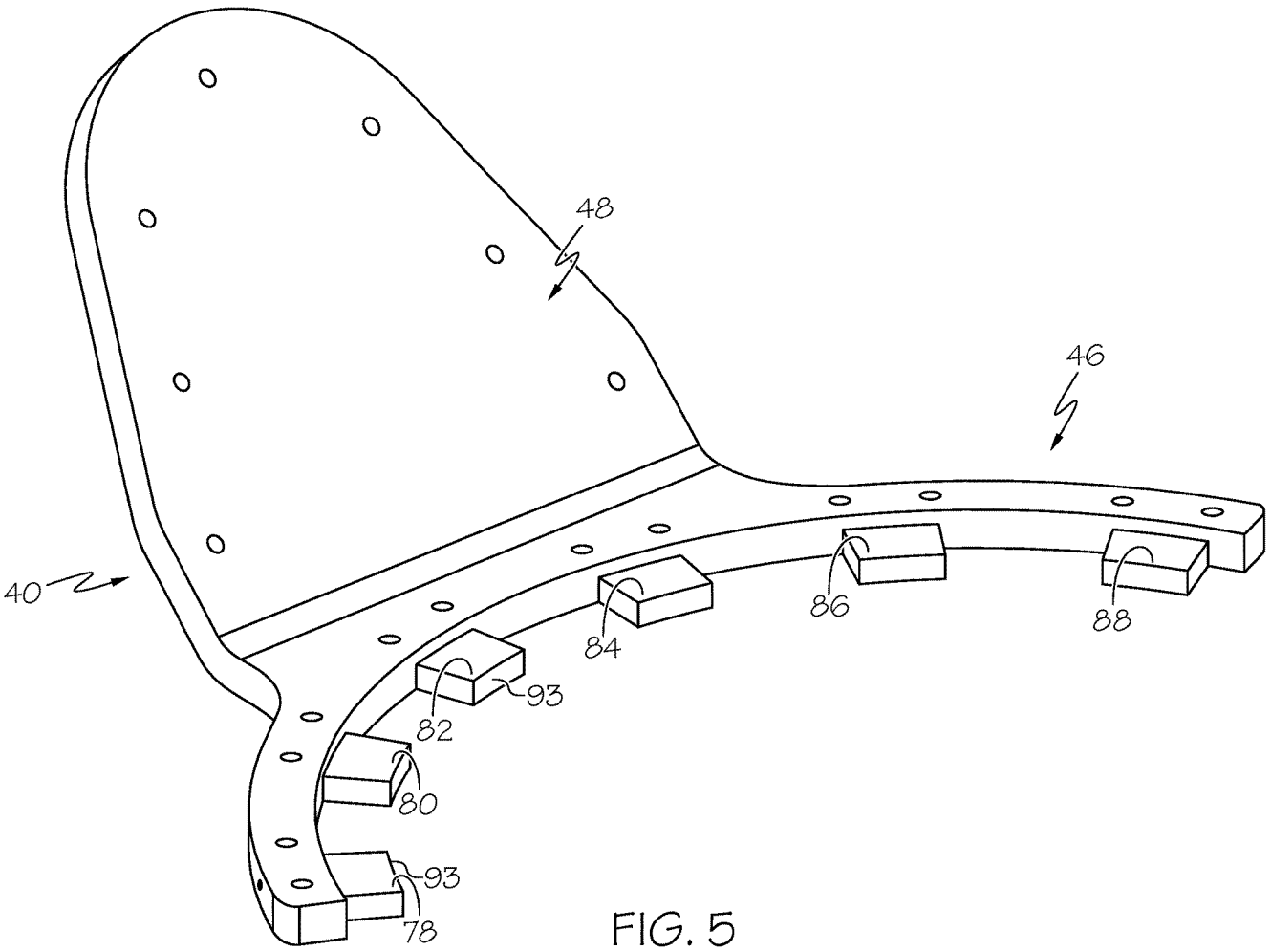
FIG. 5 is a perspective view of a lower mounting member for use with the seat support frame assembly of FIG. 3, according to one or more embodiments shown and described herein.

Referring also to FIG. 5, the lower mounting member 40 is illustrated in isolation including the seat frame mounting portion 46 and the gantry mounting portion 48. The lower mounting member 40 includes protrusions 78, 80, 82, 84, 86 and 88 that fit within slots (only slots 90, 92, 94 and 96 can be seen in FIG. 4) formed in the ring-shaped body 70. Further, the protrusions 78, 80, 82, 84, 86 and 88 may extend outwardly so as to be flush or at least extend no further than an interior surface 91 of the ring-shaped body 70 with curved ends 93 to match the curved contour of the interior surface 91. The protrusions 78, 80, 82, 84 and 86 may be provided to increase support from beneath the ring-shaped body 70.

The upper mounting member 38 and the lower mounting member 40 may be formed as monolithic structures from single pieces of material, such as steel. Any suitable process may be used for forming the upper mounting member 38 and the lower mounting member 40, such as casting, machining, etc.

Referring again to FIG. 3, the front seat receiving portion 37 of the seat support frame assembly 34 includes the seat frame member 54 having a seating member receiving opening 95 therethrough. In the illustrated example, the seat frame member 54 includes the ring-shaped body 70 that has both an inner diameter that extends between opposite sides of the interior surface 91 and an outer diameter that extends between opposite sides of an exterior surface 97. An upper surface 99 and an opposite, lower surface 98 extend between the interior surface 91 and the exterior surface 97 defining the ring-shaped body 70 having generally concentric interior and exterior surfaces 91 and 97 and parallel upper and lower surfaces 99 and 98.

Figure 6:
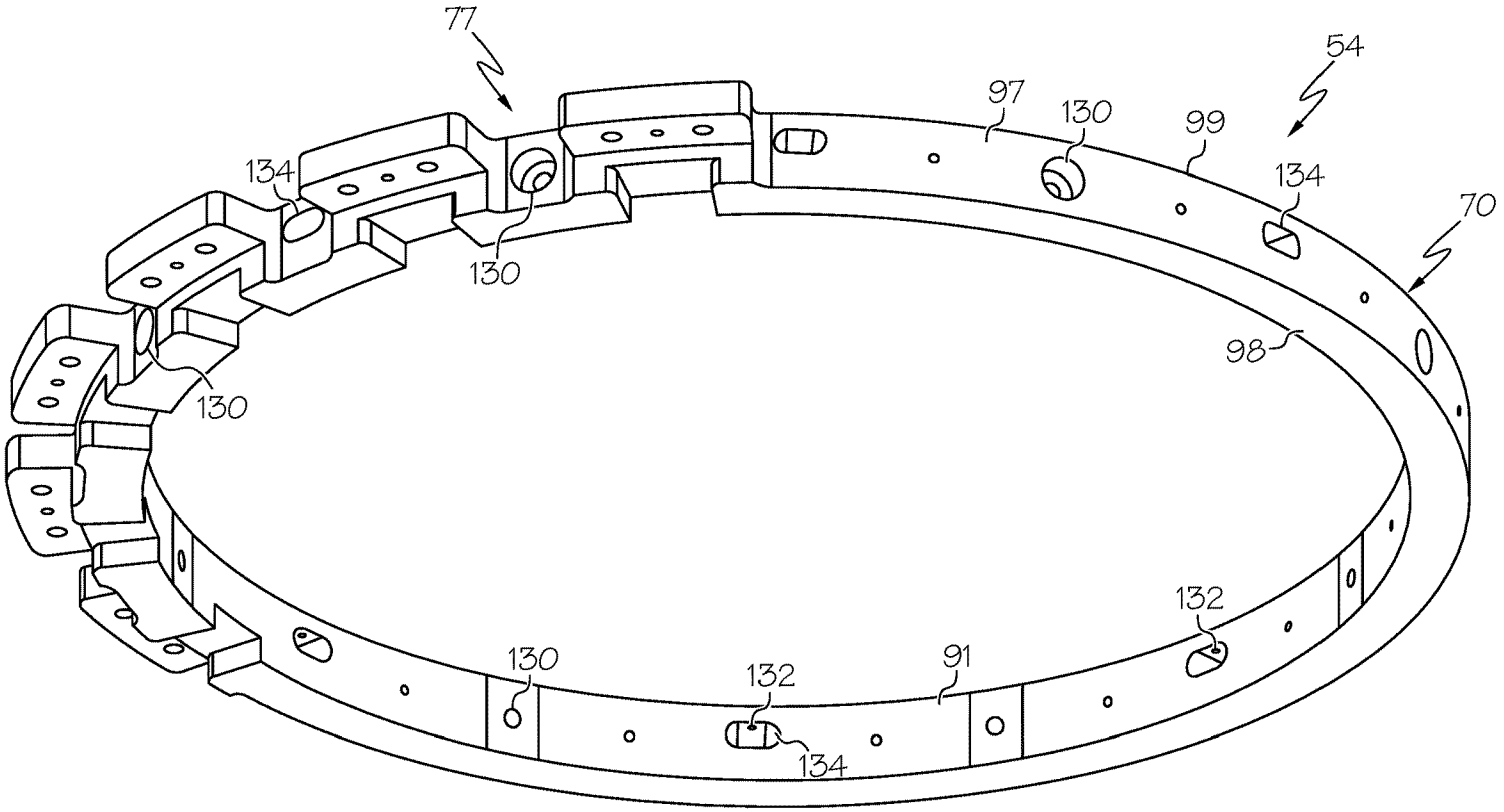
FIG. 6 is a perspective view of a seat frame member for use with the seat support frame assembly of FIG. 3, according to one or more embodiments shown and described herein.

A seating support assembly 100 includes a plurality of radial rotatable members 72, 74, 76, 104, 106, 108, 110 and 112 (e.g., roller bearings) and a plurality of vertical rotatable members 114, 116, 118, 120, 122, 124, 126 and 128 (e.g., roller bearings). Referring also to FIG. 6, each radial rotatable member 72, 74, 76, 104, 106, 108, 110 and 112 extends radially outward from an opening 130 through the interior surface 91 of the ring-shaped body 70. In some embodiments, the openings 130 may extend entirely through the ring-shaped body 70 from the interior surface 91 to the exterior surface 97. Each radial rotatable member 72, 74, 76, 104, 106, 108, 110 and 112 is rotatably received within the openings 130 and are aligned to provide a dynamic support plane along which the seating member assembly 32 can rotate.

Each vertical rotatable member 114, 116, 118, 120, 122, 124, 126 and 128 extends vertically outward from an opening 132 through the upper surface 99 of the ring-shaped body 70. In some embodiments, the openings 132 may extend only partially through the ring-shaped body 70 from the upper surface 99 toward the lower surface 98. Side slots 134 may be provided through the exterior surface 97 that intersect the openings 132 that allow access to the vertical rotatable members 114, 116, 118, 120, 122, 124, 126 and 128. In some embodiments, the side slots may extend entirely through the ring-shaped body 70 from the exterior surface 97 to the interior surface 91. Each vertical rotatable member 114, 116, 118, 120, 122, 124, 126 and 128 is rotatably received within the openings 132 and are aligned to provide a dynamic track along which the seating member assembly 32 can rotate.

The ring-shaped body 70 may be formed as a monolithic structure from a single piece of material, such as steel. Any suitable process may be used for forming the ring-shaped body, such as casting, machining, etc.

Referring back to FIG. 2, in some embodiments, a bumper member 140 formed of a relatively resilient material compared to the ring-shaped body 70 (e.g., rubber, foam, plastic, etc.) may be provided along the exterior surface 97. The bumper member 140 may provide the seat support frame assembly 34 with a relatively soft contact surface in the event the seat support frame assembly 34 comes into contact with a vehicle or other object.

The seating member assembly 32 is rotatably received within the seating member receiving opening 95 (FIG. 3) of the seat support frame assembly 34. The seating member assembly 32 includes a seat 142 (e.g., a cushion formed of a foam, rubber, plastic or any other suitable seating material) and a track ring member 144 that, as will be seen in greater detail, includes a channel that receives the vertical rotatable members 114, 116, 118, 120, 122, 124, 126 and 128.

Figure 7:
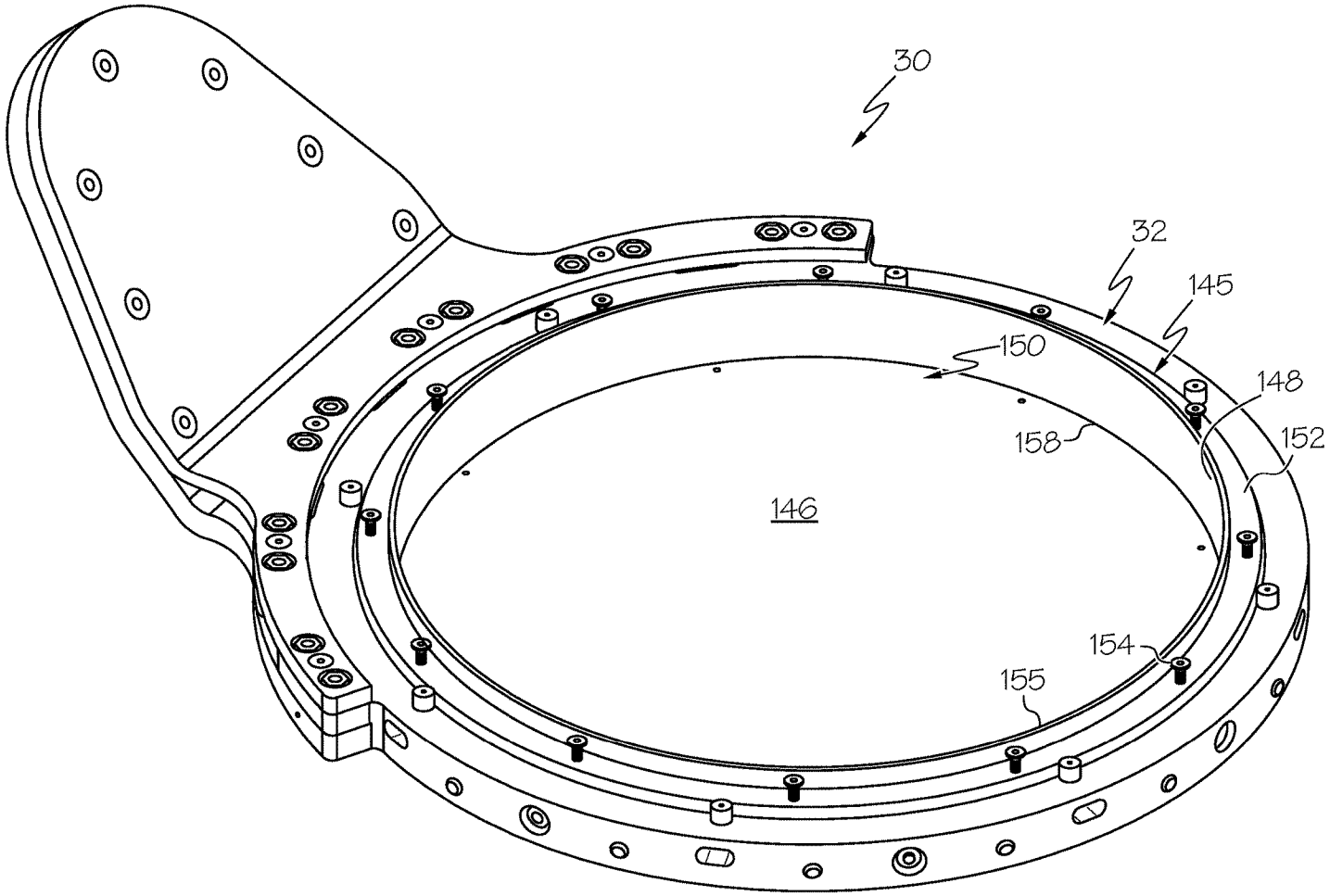
FIG. 7 is a perspective view of the seat assembly of FIG. 2 with the seat removed, according to one or more embodiments shown and described herein.

FIG. 7 illustrates the seat assembly 30 with the seat 142 removed. The seating member assembly 32 includes a seat support housing 145 that includes a bottom plate 146 and a side wall 148 that is connected to the bottom plate 146 using any suitable method, such as welding. The side wall 148 may be circular in shape having an inner diameter that is sized to receive the seat 142 within an interior volume 150 formed by the side wall 148 and the bottom plate 146 and an outer diameter that is sized to be received within the seating member receiving opening 95 (FIG. 3) with sufficient clearance alongside the radial rotatable members 72, 74, 76, 104, 106, 108, 110 and 112.

A side support ledge 152 extends radially outward from the side wall 148 at a location spaced vertically from the bottom plate 146 and located between a top edge 155 of the side wall 148 and the bottom plate 146. The side support ledge 152 may be connected to the side wall 148 by any suitable method, such as by welding, and extend continuously about an entire periphery of the side wall 148. In some embodiments, the side support ledge 152 may be a monolithic part of the side wall 148. The side support ledge 152 is rotatably supported on the radial rotatable members 72, 74, 76, 104, 106, 108, 110 and 112. The side support ledge 152 also inhibits downward movement of the seat support housing 145 through the seating member receiving opening 95. The track ring member 144 (FIG. 2) is connected directly to the side support ledge 152 using fastening locations 154.

Figure 8:
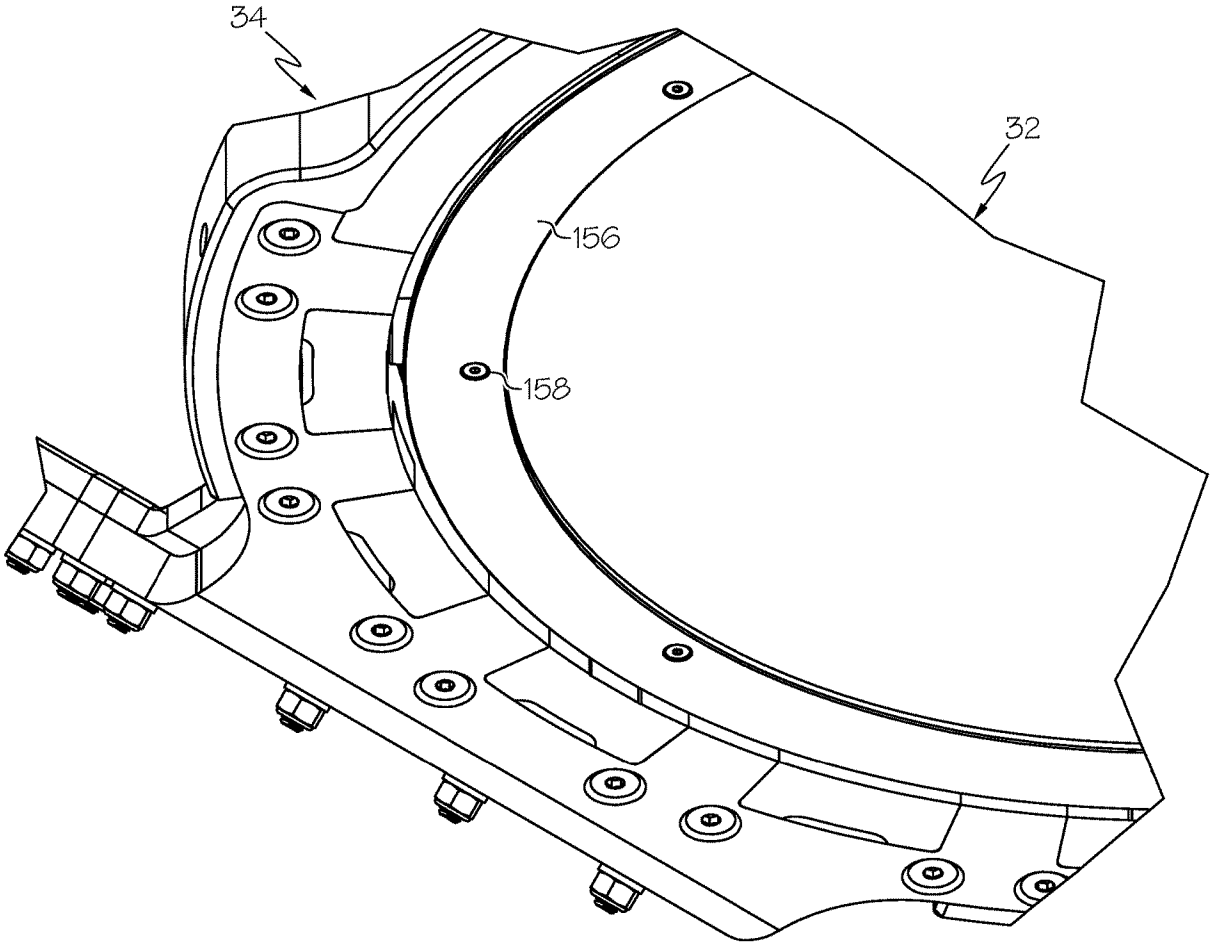
FIG. 8 is a bottom, partial perspective view of the seat assembly of FIG. 2, according to one or more embodiments shown and described herein.

Referring to FIG. 8, a bottom view of the seat support frame assembly 34 and the seating member assembly 32 is illustrated. A retaining plate 156 may be connected to the bottom plate 146 using fastening locations 158 or other suitable method such as welding. The retaining plate 156 extends radially outwardly beyond the side wall 148 to under hang the radial rotatable members 72, 74, 76, 104, 106, 108, 110 and 112 and inhibit unintended upward movement of the seating member assembly 32 from the seating member receiving opening 95.

Figure 9:
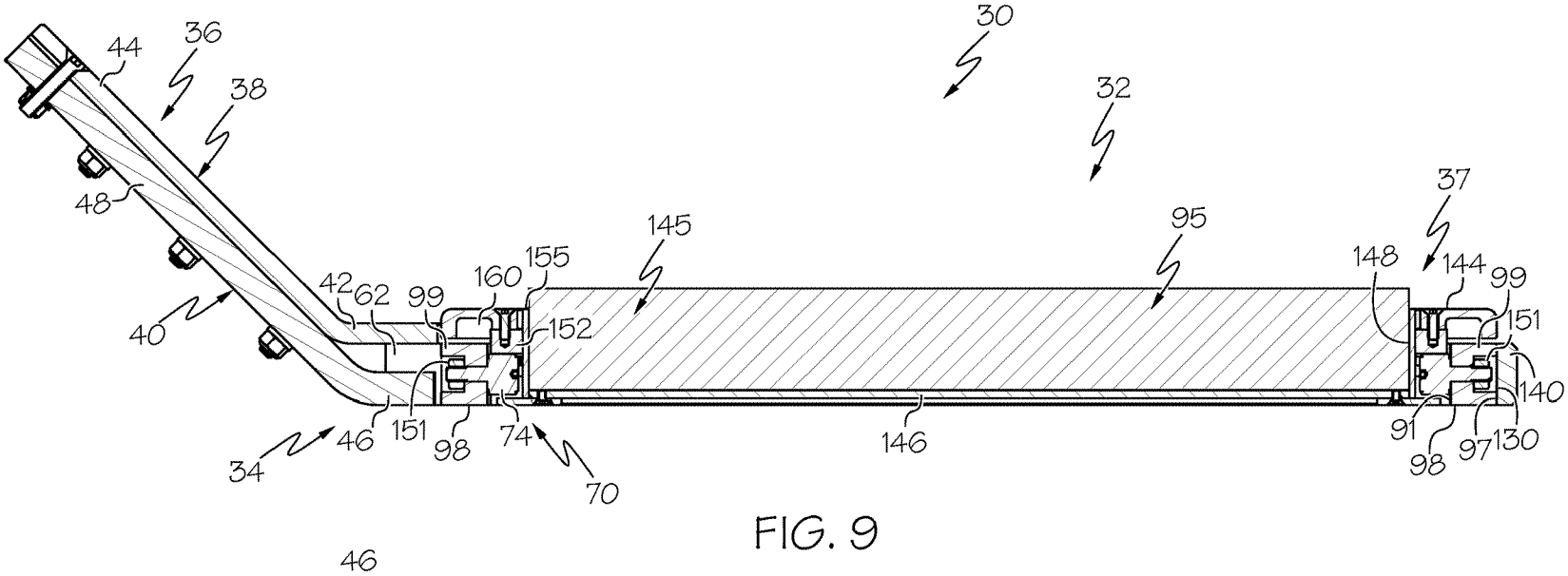
FIG. 9 is a section view of the seat assembly along line 9-9 of FIG. 2, according to one or more embodiments shown and described herein.

FIG. 9 illustrates a section view of the assembled seat assembly 30 illustrating the interaction between the seating member assembly 32 and the seat support frame assembly 34. As described above, the seat support frame assembly 34 includes the back mounting portion 36 that includes the upper and lower mounting members 38 and 40 including the gantry mounting portions 44 and 48 and the seat frame mounting portions 42 and 46 that receive the protrusions 56, 58, 60, 62 and 64 of the seat frame member 54 therebetween. The seat support frame assembly 34 further includes the front seat receiving portion 37 that includes the ring-shaped body 70 having the interior surface 91, the exterior surface 97, the upper surface 99 and the lower surface 98. The plurality of radial rotatable members 72, 74, 76, 104, 106, 108, 110 and 112 extend radially inward from openings 130 and beyond the interior surface 91. As can be seen, the openings 130 may be countersunk from the exterior surface 97 to allow increased access to retaining members 151 that retain the radial rotatable members 72, 74, 76, 104, 106, 108, 110 and 112 within their respective openings 130.

The seating member assembly 32 is received within the seating member receiving opening 95 of the seat support frame assembly 34. The seating member assembly 32 includes the seat support housing 145 that includes the bottom plate 146 and the side wall 148 that is connected to the bottom plate 146. The side wall 148 has the outer diameter or width that provides some radial clearance between the side wall 148 and the radial rotatable members 72, 74, 76, 104, 106, 108, 110 and 112 with the seating member assembly 32 located in the seating member receiving opening 95. The side support ledge 152 extends radially outward from the side wall 148 at the location between the top edge 155 of the side wall 148 and the bottom plate 146 and over hangs and rests on the radial rotatable members 72, 74, 76, 104, 106, 108, 110 and 112 thereby supporting the seating member assembly 32 along the perimeter of the side wall 148.

Figure 11:
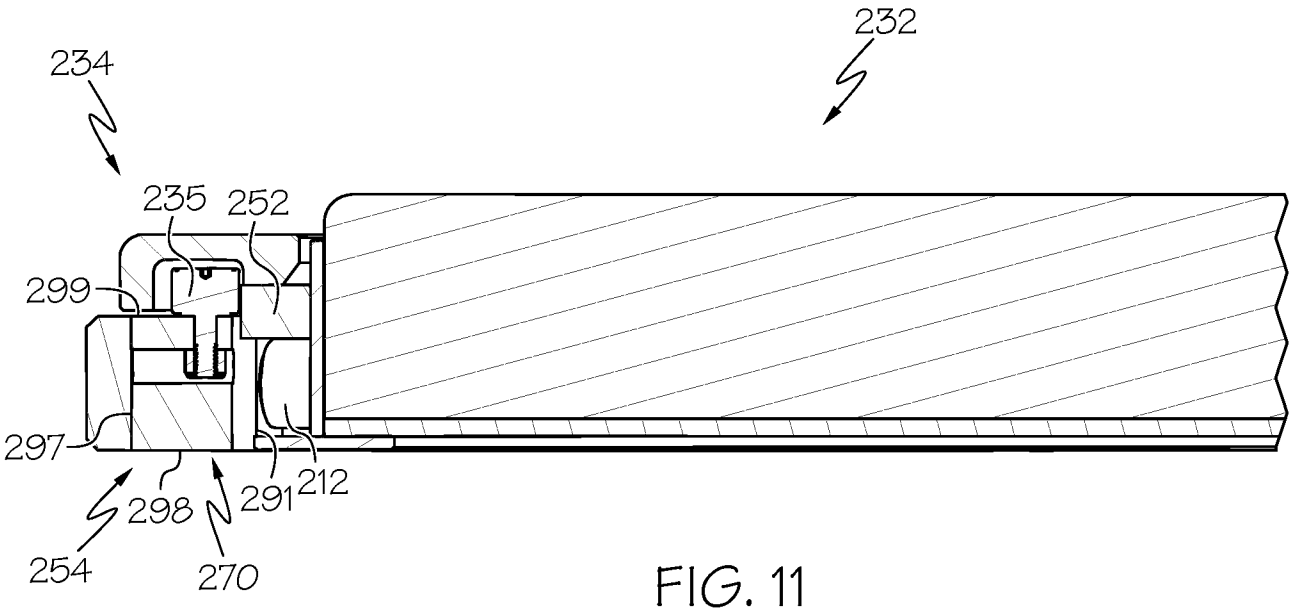
FIG. 11 is a section view of the seat assembly along line 11-11 of FIG. 10, according to one or more embodiments shown and described herein.

The track ring member 144 has an inverted U-shaped channel 160 that is sized to rotatably receive the vertical rotatable members 114, 116, 118, 120, 122, 124, 126 and 128 therein (see FIG. 11 as an example). The track ring member 144 is connected directly to the side support ledge 152. By receiving the vertical rotatable members 114, 116, 118, 120, 122, 124, 126 and 128 within the channel 160, the track ring member 144 can further inhibit side-to-side movement of the seating member assembly during use while facilitating rotational movement of the seating member assembly 32. Further, the track ring member 144 may be formed of a non-metal material, such as a plastic that is ergonomically shaped to provide added comfort around the perimeter of the seating member assembly 32.

Figure 10:
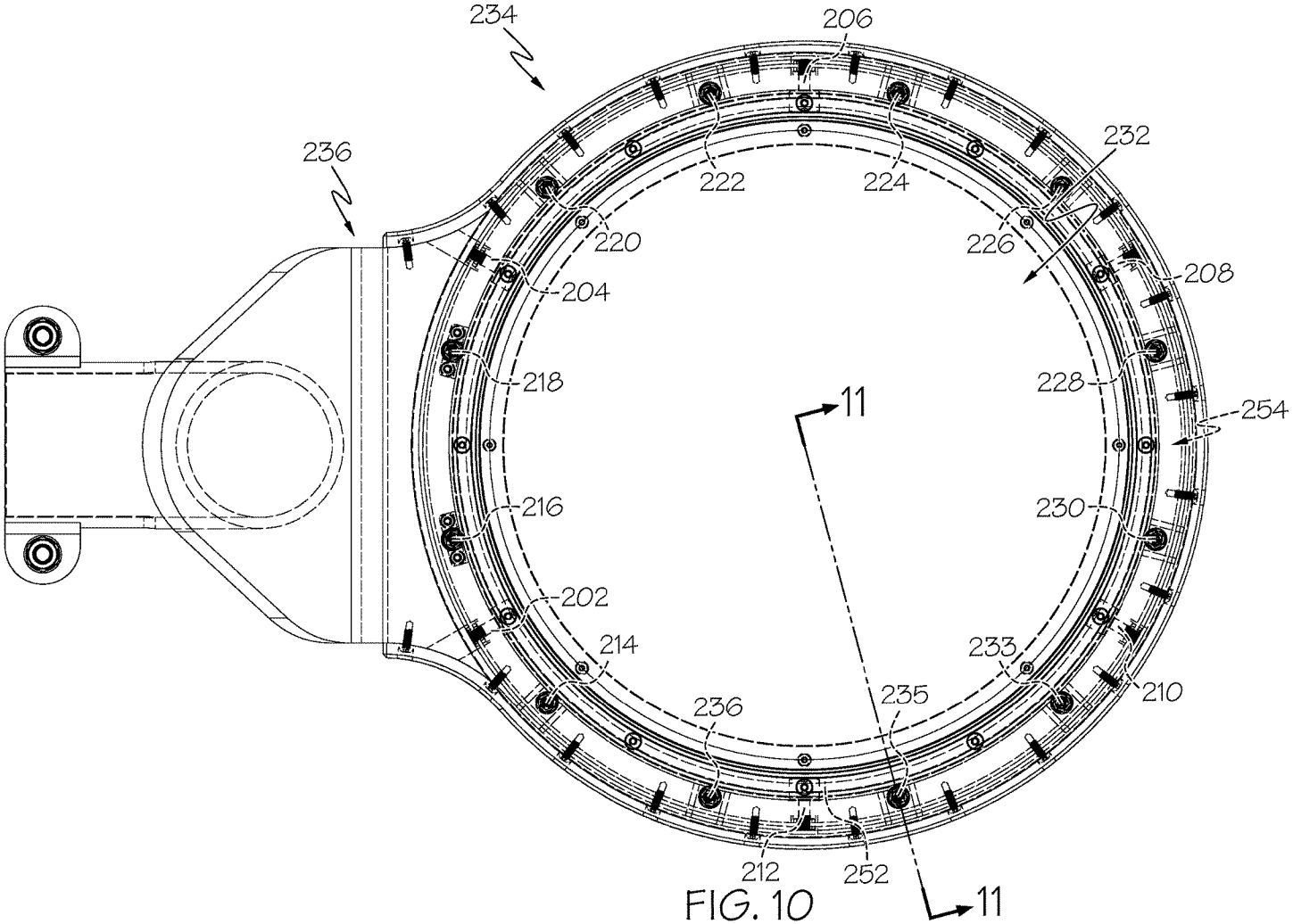
FIG. 10 is a top view of another embodiment of a seat assembly, according to one or more embodiments shown and described herein.

The above-described example seat assembly 30 is illustrated including eight radial rotatable members and eight vertical rotatable members. However, there may be more or less than eight radial rotatable members and eight vertical rotatable members depending on the requirements of a particular assembly operation. FIG. 10, for example, illustrates another seat assembly 200 that includes many of the same or similar components discussed above with regard to the seat assembly 30 including a seating member assembly 232 that is rotatably mounted to a seat support frame assembly 234. Referring also to FIG. 11, the seat support frame assembly 234 includes a seat frame member 254 having a ring-shaped body 270 having an interior surface 291, an exterior surface 297, an upper surface 299 and a lower surface 298.

As shown by dashed lines in FIG. 10, as an alternative to eight radial rotatable members, the seat frame member 254 includes six radial rotatable members 202, 204, 206, 208, 210 and 212 upon which side support ledge 252 is rotatably supported (FIG. 11). The seat frame member 254 also includes twelve vertical rotatable members 214, 216, 218, 220, 222, 224, 226, 228, 230, 233, 235 and 236. Decreasing the number of radial rotatable members to six can allow for more spacing between adjacent radial rotatable members (while maintaining equidistant spacing between the radial rotatable members), which can increase accessibility to the radial rotatable members 202 and 204 that are located nearest back mounting portion 236. Increasing the number of vertical rotatable members can provide additional side-to-side support to inhibit side-to-side movement of the seating member assembly 232 using engagement between track ring member 244 and the vertical rotatable members 214, 216, 218, 220, 222, 224, 226, 228, 230, 233, 235 and 236 in a fashion similar to that described above.

Figure 12:
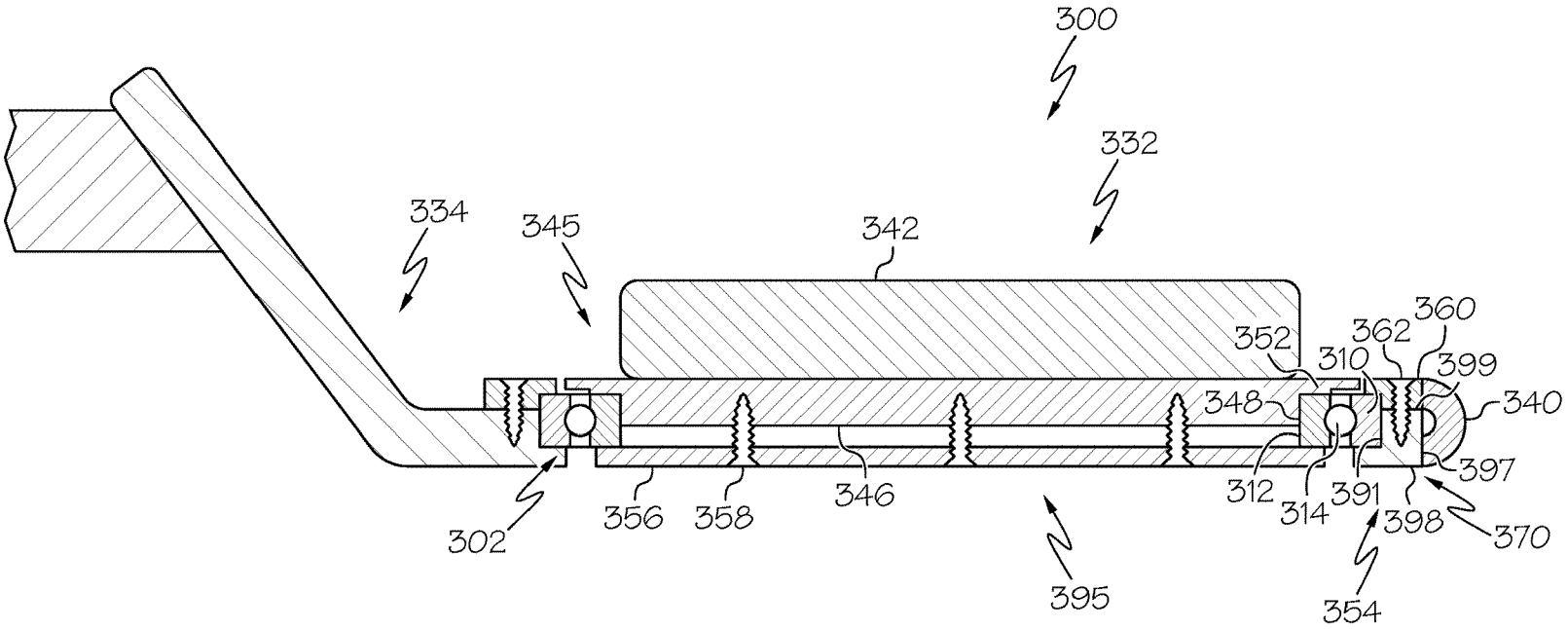
FIG. 12 is a diagrammatic section view of another embodiment of a seat assembly, according to one or more embodiments shown and described herein.

Referring to FIG. 12, another embodiment of a seat assembly 300 uses a rotatable member 302 in the form of a bearing assembly (e.g., a slim line bearing assembly) as an alternative to the separate, spaced-apart radial rotatable members described above. The seat assembly 300 includes many of the same or similar components discussed above with regard to the seat assemblies 30 and 200 including a seating member assembly 332 that is rotatably mounted to a seat support frame assembly 334. The seat support frame assembly 334 includes a seat frame member 354 having a ring-shaped body 370 having an interior surface 391, an exterior surface 397, an upper surface 399 and a lower surface 398.

The rotatable member 302 includes an outer race 310, an inner race 312 and rotating elements 314 (e.g., balls, rollers, etc.) that allow the inner race 312 to rotate relative to the outer race 310. The seat frame member 354 and inner race 312 have inner diameters that provide a seating member opening 395 that allows the seating member assembly 332 to be at least partially received within the seating member opening 395. The seating member assembly 332 includes a seat 342 and a seat support housing 345 that includes a bottom portion 346 that is received within the seating member opening 395. The bottom portion 346 includes a side support ledge 352 that extends radially outward from a side wall 348. The seating member assembly 332 is supported vertically by the rotatable member 302 that is located about a periphery of the bottom portion 346. A retaining plate 356 may be connected to the bottom portion 346 at fastening locations 358 and extend underneath the inner race 312 of the rotatable member 302. Another retaining plate 360 may be connected to the seat frame member 354 at fastening location and extend over the outer race 310. A bumper member 340 may provide a relatively soft contact surface.

The above-described seat assemblies include seating member assemblies that are perimeter supported by rotatable members that both support the seating member assemblies vertically and also provide the seat member assemblies with an ability to rotate. Supporting the seat assemblies form their perimeters using the rotatable members eliminates any need to provide rotatable members, such as a bearing below the seat member assemblies, which can increase a height of the overall seat assembly. Lowering the profiles of the seat assemblies (measured from the top of the seats vertically to the bottom of the seat assemblies) can reduce a height of an operator who is sitting on the seat assemblies thereby increasing the headspace for the operator. While vehicle assembly operations and gantry assemblies are discussed above, the seat assemblies described here may be used for other operations where increased head space may be desired.

It is noted that the terms "substantially" and "about" may be utilized herein to represent the inherent degree of uncertainty that may be attributed to any quantitative comparison, value, measurement, or other representation. These terms are also utilized herein to represent the degree by which a quantitative representation may vary from a stated reference without resulting in a change in the basic function of the subject matter at issue.

Directional terms used herein—for example widthwise, lengthwise, vertical, up, down, right, left, front, back, top, bottom, upper, lower—are made only to supply directional context.

While particular embodiments have been illustrated and described herein, it should be understood that various other changes and modifications may be made without departing from the spirit and scope of the claimed subject matter. Moreover, although various aspects of the claimed subject matter have been described herein, such aspects need not be utilized in combination. It is therefore intended that the appended claims cover all such changes and modifications that are within the scope of the claimed subject matter.

What is claimed is:

1. A seat assembly comprising:

a seat support frame assembly comprising a mounting structure that mounts to a seat support structure and a seat receiving portion, the seat receiving portion comprising a seat frame member having a body having an interior surface that defines a seat member receiving opening having an inner diameter;

a rotatable member that extends from the interior surface of the body into the seat member receiving opening; and a seating member assembly that is rotatably received in the seat member receiving opening, the seating member assembly comprising a seat support housing that supports a seat, the seat support housing comprising a side wall and a side support ledge that overhangs the rotatable member to rotatably support the seating member along a perimeter of the side wall of the seat support housing;

wherein the rotatable member is a radial rotatable member that extends radially inward from the interior surface of the body into the seat member receiving opening.

2. The seat assembly of claim 1 comprising a plurality of radial rotatable members that extend radially inward from the interior surface of the body and are spaced-apart around the perimeter of the side wall of the seat support housing.

3. The seat assembly of claim 1, wherein the seat support housing comprises a bottom plate connected to the side wall defining an interior volume that receives a seat.

4. The seat assembly of claim 3 further comprising a seat located in the interior volume.

5. The seat assembly of claim 3, wherein the side wall is closed in shape and has an outer diameter, the side support ledge extending continuously around the side wall.

6. The seat assembly of claim 3, wherein the side support ledge is spaced from the bottom plate.

7. The seat assembly of claim 1, wherein the body has the interior surface, an exterior surface, an upper surface that extends between the interior surface and the exterior surface and a lower surface that extends between the interior surface and the exterior surface, the seat assembly further comprising a plurality of vertical rotatable members that extend from the upper surface.

8. The seat assembly of claim 7, wherein the seating member assembly further comprises a track ring member that is connected to the side support ledge, the track ring member having a channel extending therethrough, the plurality of vertical rotatable members received within the channel.

9. The seat assembly of claim 1, wherein the rotatable member is a bearing assembly.

10. A seat assembly comprising: a seat support frame assembly comprising a mounting structure that mounts to a seat support structure and a seat receiving portion, the seat receiving portion comprising a seat frame member having a body having an interior surface that defines a seat member receiving opening having an inner diameter, a rotatable member that extends from the interior surface of the body into the seat member receiving opening; and a seating member assembly that is rotatably received in the seat member receiving opening, the seating member assembly comprising a seat support housing that supports a seat, the seat support housing comprising a side wall; wherein the rotatable member engages the seat support housing along a height of the side wall thereby supporting the seating member assembly vertically such that the seating member rotates in response to an external force applied to the seating member assembly.

11. The seat assembly of claim 10, wherein the seat support housing comprises a side support ledge that extends radially outward from the side wall and overhangs the rotatable member to rotatably support the seating member along a perimeter of the side wall of the seat support housing.

12. The seat assembly of claim 11, wherein the body has the interior surface, an exterior surface, an upper surface that extends between the interior surface and the exterior surface and a lower surface that extends between the interior surface and the exterior surface, the seat assembly further comprising a plurality of vertical rotatable members that extend from the upper surface.

13. The seat assembly of claim 12 comprising a plurality of radial rotatable members that extend radially inward from the interior surface of the body and are spaced-apart around a perimeter of the side wall of the seat support housing.

14. The seat assembly of claim 12, wherein the seating member assembly further comprises a track ring member that is connected to the side support ledge, the track ring member having a channel extending therethrough, the plurality of vertical rotatable member received within the channel.

15. The seat assembly of claim 10, wherein the rotatable member is a radial rotatable member that extends radially inward from the interior surface of the body into the seat member receiving opening.

16. The seat assembly of claim 10, wherein the rotatable member is a bearing assembly.

17. A method of rotatably supporting a seating member assembly within a seat support frame assembly, the method comprising: placing a seating member assembly within a seat member receiving opening of a seat support frame, the seat support frame comprising a seat receiving portion comprising a seat frame member having a body having an interior surface with an inner diameter that defines a seat member receiving opening; and locating a side support ledge of a seat support housing on a rotatable member that extends from the interior surface of the body into the seat member receiving opening, the seat support housing comprising a side wall and the side support ledge that extends outwardly from the side wall, the rotatable member supporting the seat support housing along a perimeter of the side wall.

18. The method of claim 17, wherein the rotatable member is a radial rotatable member that extends radially inward from the interior surface of the body into the seat member receiving opening, the seat frame member further comprising a plurality of radial rotatable members that extend radially inward from the interior surface of the body and are spaced-apart around the perimeter of the side wall of the seat support housing.

19. The method of claim 18, wherein the rotatable member is a bearing assembly.

* * * * *